US006624371B2

(12) United States Patent
Dufournet et al.

(10) Patent No.: US 6,624,371 B2
(45) Date of Patent: Sep. 23, 2003

(54) CIRCUIT-BREAKER INCLUDING A CHANNEL FOR EMPTYING THE PISTON-DRIVEN COMPRESSION CHAMBER

(75) Inventors: Denis Dufournet, Sathonay Camp (FR); Wolfgang Grieshaber, Lyons (FR); Michel Perret, Bourgoin Jallieu (FR)

(73) Assignee: Alstom, Paris (FR)

( * ) Notice: Subject to any disclaimer, the term of this patent is extended or adjusted under 35 U.S.C. 154(b) by 0 days.

(21) Appl. No.: 10/059,360

(22) Filed: Jan. 31, 2002

(65) Prior Publication Data

US 2002/0117475 A1 Aug. 29, 2002

(30) Foreign Application Priority Data

Feb. 27, 2001 (FR) ..... 01 02627

(51) Int. Cl.[7] ..... H01H 33/88
(52) U.S. Cl. ..... 218/61; 218/59
(58) Field of Search ..... 218/51–54, 57, 218/59–61, 62–64, 66

(56) References Cited

U.S. PATENT DOCUMENTS 3,988,554 A * 10/1976 Graf et al. ..... 218/64
4,046,979 A 9/1977 Hertz et al.
5,600,111 A * 2/1997 Dufournet ..... 218/61

FOREIGN PATENT DOCUMENTS

| | | |
|---|---|---|
| DE | 11 27 442 B | 4/1962 |
| DE | 295 20 809 U | 2/1996 |
| DE | 196 13 030 A | 9/1997 |
| WO | WO 96 21234 A | 7/1996 |

* cited by examiner

*Primary Examiner*—Elvin Enad
*Assistant Examiner*—M. Fishman
(74) *Attorney, Agent, or Firm*—Sughrue Mion, PLLC

(57) ABSTRACT

A circuit-breaker includes two contacts which are disposed in an interrupting space filled with a dielectric gas under pressure and between which an electric arc strikes during circuit-breaker opening, a thermal blast chamber communicating directly with the interrupting space, and a piston-driven compression chamber communicating with the thermal blast chamber. The piston-driven compression chamber communicates with the interrupting space via a discharge channel that is separate from the thermal blast chamber and that is closed by a discharge valve. The discharge valve is disposed between the thermal blast chamber and the piston-driven compression chamber in a manner such that the discharge valve opens to enable the gas under increased pressure in the piston-driven compression chamber to be discharged towards the interrupting space via the channel when the increase in the pressure of the gases in the thermal blast chamber is larger than the increase in the pressure of the gases in the piston-driven compression chamber.

4 Claims, 1 Drawing Sheet

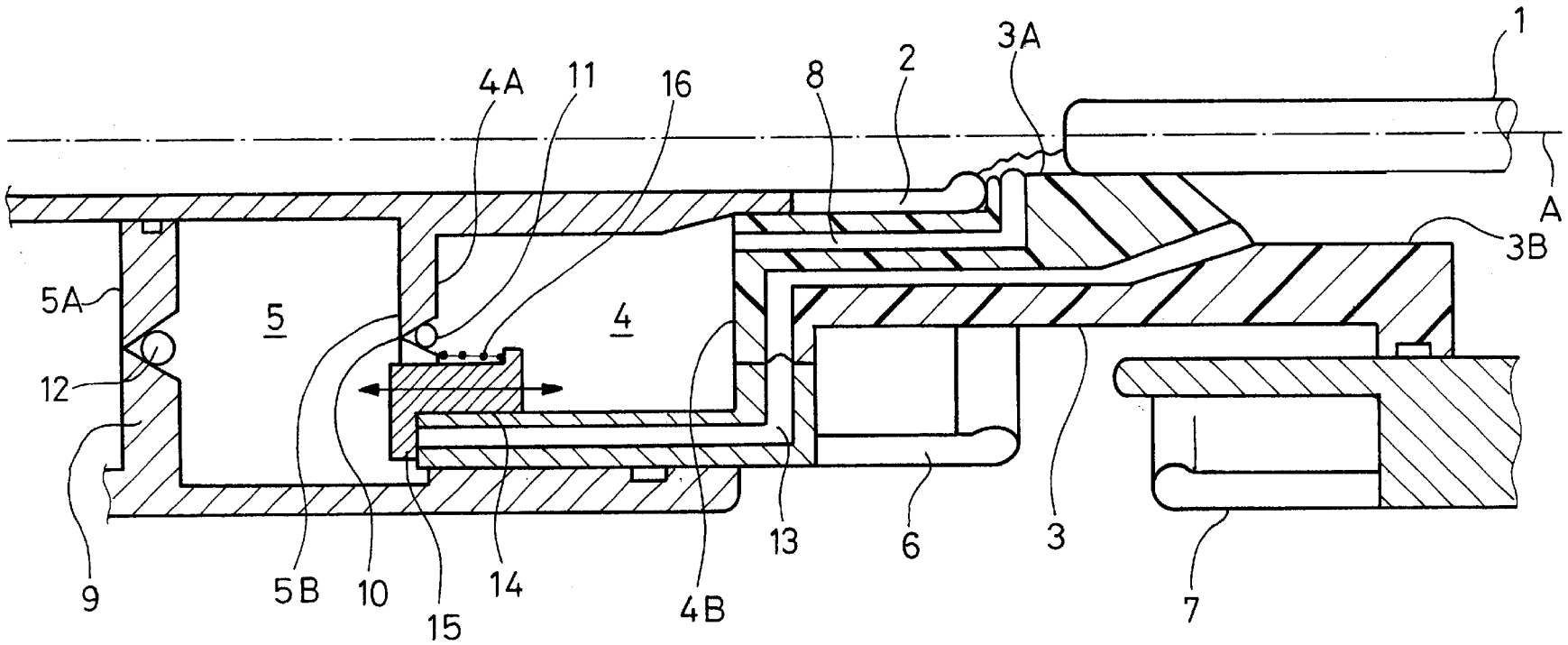
1
A
3B
3A
2
8
16
11
4A
4
5
5A
12
9
5B
10
15
14
4B
13
6
3
7

CIRCUIT-BREAKER INCLUDING A CHANNEL FOR EMPTYING THE PISTON-DRIVEN COMPRESSION CHAMBER

The invention relates to a circuit-breaker including two contacts which are disposed in an interrupting space filled with a dielectric gas under pressure and between which an electric arc strikes during circuit-breaker opening, the circuit-breaker further including a thermal blast chamber that communicates directly with the interrupting space, and a piston-driven compression chamber that communicates with the thermal blast chamber, in which circuit-breaker the piston-driven compression chamber communicates with the interrupting space via a discharge channel that is separate from the thermal blast chamber and that is closed by a discharge valve.

BACKGROUND OF THE INVENTION

Such a high-voltage circuit-breaker is known from German Patent DE-19613030. In that known circuit-breaker, the interrupting space is defined by the neck and the diverging portion of a nozzle secured to the moving contact of the circuit-breaker. When the circuit-breaker is in the closed position, the fixed contact of the circuit-breaker passes through the neck of the nozzle. The thermal blast chamber and the discharge channel open out directly in the neck of the nozzle, and the discharge valve is mounted between the piston-driven compression chamber and the discharge channel in a manner such as to prevent any gas from returning from the interrupting space to the piston-driven compression chamber. The discharge channel is connected to the neck of the nozzle in a manner such that, during circuit-breaker opening, the thermal blast chamber is put in communication with the interrupting space before the piston-driven compression chamber is put in communication with the interrupting space via the discharge channel.

When interrupting low current, the pressure of the dielectric gas increases more quickly in the piston-driven compression chamber than in the thermal blast chamber. Because of the difference between the increases in the pressures of the gas in the two chambers, the check valve that is placed in the communication channel via which the two chambers can communicate opens and the gas under increased pressure in the piston-driven compression chamber is blasted into the interrupting space through the thermal blast chamber. Unfortunately, a portion of the gas under increased pressure in the piston-driven compression chamber is also discharged into the interrupting space through the discharge channel. The effect of the gas being discharged through the discharge channel is to reduce the intrinsic capacity of the piston-driven compression chamber to extinguish an arc by blasting it.

When interrupting high current, the pressure of the gas in the thermal blast chamber increases more quickly than the pressure of the gas in the piston-driven compression chamber. Because of the difference between the increases in the pressures of the gas in the two chambers, the communication channel via which the two chambers can communicate is closed by the check valve so that it is the gas under increased pressure in the thermal blast chamber that is blasted into the interrupting space between the two contacts. When the fixed contact uncovers the mouth of the discharge channel in the neck in the nozzle, there is a risk that the electric arc might develop at the mouth of the discharge channel because of the small diameter of the neck of the nozzle, and, by heating the gases, might cause them to return from the interrupting space towards the piston-driven compression chamber. Although such return is stopped by the check valve of the discharge channel, the piston-driven compression chamber can then no longer be emptied, and the increase in the pressure of the gas in said chamber causes an opposing force that opposes the movement of the moving contact of the circuit-breaker, and can cause the circuit-breaker opening operation to be stopped undesirably.

European Patent Application EP-806049 also discloses a circuit-breaker, in which the compression piston in the piston-driven compression chamber is provided with calibrated valves which open when the increase in the pressure of the gas in the piston-driven compression chamber crosses a critical threshold. In that way, when interrupting high current, the piston-driven compression chamber is emptied via the rear of the piston, but the gas under increased pressure in said chamber is then not used for interrupting the arc, and it is therefore lost.

OBJECTS AND SUMMARY OF THE INVENTION

An object of the invention, is to provide a circuit-breaker that does not suffer from the above-mentioned drawbacks. In particular, an object of the invention is to provide a circuit-breaker in which, when interrupting low current, all of the gas under increased pressure in the piston-driven compression chamber goes through the thermal blast chamber to blast the electric arc that strikes between the two contacts of the circuit-breaker, and in which, when interrupting high current, the piston-driven compression chamber is emptied fully without using calibrated valves in the compression piston, but rather by discharging the gas into the interrupting space via a separate discharge channel, this injection of non-ionized or little-ionized gas contributing to regenerating the hot gases present in the interrupting space so as to improve the dielectric strength of the circuit-breaker during subsequent opening thereof.

To this end, the invention provides a circuit-breaker including two contacts which are disposed in an interrupting space filled with a dielectric gas under pressure and between which an electric arc strikes during circuit-breaker opening, the circuit-breaker further including a thermal blast chamber that communicates directly with the interrupting space, and a piston-driven compression chamber that communicates with the thermal blast chamber, in which circuit-breaker the piston-driven compression chamber communicates with the interrupting space via a discharge channel that is separate from the thermal blast chamber and that is closed by a discharge valve, wherein said discharge valve is disposed between the thermal blast chamber and the piston-driven compression chamber in a manner such that said discharge valve opens to enable the gas under increased pressure in the piston-driven compression chamber to be discharged towards the interrupting space via said channel when the increase in the pressure of the gases in the thermal blast chamber is larger than the increase in the pressure of the gases in the piston-driven compression chamber. Thus, with this configuration, the discharge valve is moved by the resultant force corresponding to the difference between the increase in the pressure of the gases in the thermal blast chamber and the increase in the pressure of the gases in the piston-driven compression chamber. When interrupting low current, the increase in pressure in the piston-driven compression chamber is larger than in the thermal blast chamber and the resultant force that acts on the discharge valve tends to hold it in its closed position so as to prevent the piston-driven compression chamber from emptying through the discharge channel. The gases in the piston-driven compression chamber are thus blasted into the interrupting space through the check valve, and through the thermal blast chamber. Conversely, when interrupting high current, the resultant force that acts on the discharge valve tends to move it so as to open the discharge channel, thereby enabling the piston-driven compression chamber to be emptied into the interrupting space.

In a particularly simple embodiment of the circuit-breaker of the invention, the discharge valve is a moving ring that passes through the bottom of the thermal blast chamber and through the top of the piston-driven compression chamber, and the discharge channel has an opening via which it opens out in the top of the piston-driven compression chamber. The ring is pressed against the opening in the discharge channel under the action of a return spring that works between the ring and the bottom of the thermal blast chamber. With this configuration, when the pressures in the thermal blast chamber and in the piston-driven compression chamber are equal, the ring closes off the discharge channel and prevents the piston-driven compression chamber from emptying towards the interrupting space.

In another particular embodiment of the circuit-breaker of the invention, the interrupting space is defined by a nozzle that has a diverging portion, and the discharge channel opens into the diverging portion downstream from the neck of the nozzle. This construction removes the risk of the discharge channel being blocked by the electric arc.

BRIEF DESCRIPTION OF THE DRAWING

The circuit-breaker of the invention is described below in detail and is shown diagrammatically in the sole FIGURE.

MORE DETAILED DESCRIPTION

The FIGURE is a diagrammatic axial half-section view showing an embodiment of a high-voltage circuit-breaker of the invention. The circuit-breaker includes a fixed arcing contact 1 in the form of a rod, and a moving arcing contact 2 which moves axially along the axis A. The contact 2 is hollow and is part of moving equipment including a blast nozzle 3 that is coaxial with the contacts 1 and 2, a thermal blast chamber 4, and a piston-driven compression chamber 5. The moving equipment also includes a permanent current contact 6 which, when the circuit-breaker is closed, co-operates with a permanent current contact 7 that is fixed.

The nozzle 3 is made of an electrically-insulating material, and it has a diverging portion 3B downstream from its neck 3A which is of smaller section. When the circuit-breaker is closed, the arcing contact 1 passes through the neck 3A of the nozzle and penetrates into the hollow contact 2 which is disposed upstream from the neck 3A of the nozzle, relative to the direction in which the contact 2 is closed.

The neck 3A and the diverging portion 3B of the nozzle define the interrupting space for interrupting an electric arc that stretches between the two contacts 1 and 2 during circuit-breaker opening. The interrupting space is filled with an insulating dielectric gas such as $SF_6$ under a pressure of a few bars, e.g. 3 bars.

The interrupting space communicates with the thermal blast chamber 4 via an annular channel 8 that is formed in the nozzle 3 and that opens out on the interrupting space side in the neck 3A of the nozzle.

The thermal blast chamber 4 defines a fixed annular volume which is coaxial with the contacts 1 and 2, and in which the pressure of the dielectric gas is increased by it being heated through contact with the electric arc that strikes between the contacts 1 and 2 during opening.

The piston-driven compression chamber 5 is adjacent to the chamber 4, and it defines a variable annular volume which is also coaxial with the contacts 1 and 2, and in which the pressure of the dielectric gas is increased by means of a piston 9 moving, which piston constitutes the bottom 5A of the chamber 5. As shown in the figure, the top 5B of the chamber 5 coincides with the bottom 4A of the chamber 4, and the channel 8 opens out in the top 4B of the chamber 4.

The thermal blast chamber 4 communicates with the piston-driven compression chamber 5 via a channel 10 passing through the bottom 4A and the top 5B. The channel 10 is closed by a check valve 11 which allows the gas to flow only from the chamber 5 to the chamber 4. The bottom 5A of the piston-driven compression chamber, which bottom also constitutes the piston 9, is also provided with a through channel that is closed by a check valve 12 which allows the gas to flow only from behind the piston into the chamber 5, during circuit-breaker closure.

As shown in the figure, the piston-driven compression chamber 5 communicates with the interrupting space via an annular channel 13 that is coaxial with the contacts 1 and 2, and that opens out at one end in the diverging portion 3B of the nozzle and at the other end in the top 5B of the piston-driven compression chamber 5. A discharge valve 14 is also disposed between the thermal blast chamber 4 and the piston-driven compression chamber 5. It passes through the top 5B or the bottom 4A and opens into the piston-driven compression chamber 5. In this example, the discharge valve 14 is in the form of a ring mounted to move along the axis A as indicated by the arrow. The ring 14 is provided with a peripheral annular lip 15 that extends radially under the opening in the channel 13 where it opens into the chamber 5. An annular spring 16 works between the bottom 4A of the thermal blast chamber 4 and the ring 14 to close the channel 13 by holding the lip 15 against the opening in the channel 13 where it opens into the chamber 5. The ring 14 moving leftwards in the figure and thus into the chamber 5 opens the channel 13, while the ring 14 moving rightwards in the figure and thus into the chamber 4 tends to close the channel 13.

When high current is being interrupted, the pressure of the volume of gas in the chamber 4 increases more quickly than the pressure of the volume of gas in the chamber 5, and the check valve 11 closes the channel 10 between the compression chambers 4 and 5. Since the pressure increase in the chamber 4 is larger than the pressure increase in the chamber 5, the resultant force tends to move the ring 14 towards the left of the figure and thus to open the channel 13, thereby enabling gases to be discharged from the chamber 5 towards the interrupting space in the diverging portion of the nozzle. On current zero, the gas under increased pressure in the chamber 4 is blasted out of the outlet of the channel 8 onto the root of the electric arc that stretches between the two contacts 1 and 2, and a few hundreds of microseconds after current zero, the chamber 5 is emptied into the interrupting space via the channel 13. The unpolluted or little-polluted gas coming from the chamber 5 is thus used advantageously to regenerate the hot gases present in the downstream portion of the nozzle after the arc has been interrupted. This regeneration of the dielectric medium in the interrupting space is important because a circuit-breaker is usually designed to perform an opening and closure sequence with subsequent opening then being possible. It is therefore important for the subsequent opening to take place under conditions of optimum dielectric strength. Furthermore, this additional blasting makes it possible to improve capacity to withstand the voltage re-established a few hundreds of microseconds after current zero.

When a low current is being interrupted, the pressure of the volume of gas in chamber 5 increases more quickly than the pressure of the volume of gas in chamber 4, and the check valve 11 opens the channel 10, thereby putting the chambers 4 and 5 in communication with each other. Since the pressure increase in chamber 5 is larger than the pressure increase in chamber 4, the resultant force tends to move the ring 14 towards the right of the figure, and acts in addition to the force exerted by the spring 16, so that the lip 15 of the ring closes the discharge channel 13. On current zero, all of the gas under increased pressure in chamber 5 is blasted into the interrupting space and onto the root of the electric arc through the channel 10, the chamber 4, and the channel 8. After current zero, the discharge channel 13 is still closed off by the ring 14, which prevents hot gases from returning from the interrupting space to the chamber 5.

In the figure, it can be seen that a portion of the length of the discharge channel 13 extends parallel to the axis A in the thickness of the outer wall of the thermal blast chamber 4. Thus, the discharge channel 13 does not pass through the volume of gas defined by the thermal blast chamber.

What is claimed is:

1. A circuit-breaker comprising:

two contacts which are disposed in an interrupting space filled with a dielectric gas under pressure and between which an electric arc strikes during circuit-breaker opening;

a thermal blast chamber that communicates directly with the interrupting space to blast pressurized gas onto the electric arc; and a piston-driven compression chamber that communicates with the thermal blast chamber, in which circuit-breaker the piston-driven compression chamber communicates with the interrupting space via a discharge channel that is separate from the thermal blast chamber and that is closed by a discharge valve, wherein said discharge valve is disposed between the thermal blast chamber and the piston-driven compression chamber in a manner such that said discharge valve opens to enable the gas under increased pressure in the piston-driven compression chamber to be discharged towards the interrupting space via said discharge channel when the increase in the pressure of the gases in the thermal blast chamber is larger than the increase in the pressure of the gases in the piston-driven compression chamber.

2. The circuit-breaker according to claim 1, in which the discharge valve is a moving ring that passes through the bottom of the thermal blast chamber and through the top of the piston-driven compression chamber, in which circuit-breaker the discharge channel has an opening via which it opens out in the top of the piston-driven compression chamber, and in which circuit-breaker said ring is pressed against the opening in the discharge channel under the action of a return spring that works between the ring and the bottom of the thermal blast chamber.

3. The circuit-breaker according to claim 1, in which the interrupting space is defined by a nozzle that has a diverging portion into which the discharge channel opens.

4. The circuit-breaker according to claim 1, in which the discharge channel is formed in a wall of the thermal blast chamber.

* * * * *